US005797120A

United States Patent [19]

Ireton

[11] Patent Number: 5,797,120

[45] Date of Patent: Aug. 18, 1998

[54] SYSTEM AND METHOD FOR GENERATING RE-CONFIGURABLE BAND LIMITED NOISE USING MODULATION

[75] Inventor: Mark A. Ireton, Travis, Tex.

[73] Assignee: Advanced Micro Devices, Inc., Sunnyvale, Calif.

[21] Appl. No.: 707,700

[22] Filed: Sep. 4, 1996

[51] Int. Cl.[6] ..... G10L 3/02

[52] U.S. Cl. ..... 704/226; 704/225

[58] Field of Search ..... 704/226, 261, 704/227, 228, 233, 225

[56] References Cited

U.S. PATENT DOCUMENTS

| | | | |
|---|---|---|---|
| 3,909,533 | 9/1975 | Williman | 704/261 |
| 4,170,719 | 10/1979 | Fujimura | 704/208 |
| 4,544,919 | 10/1985 | Gerson | 341/75 |
| 4,817,157 | 3/1989 | Gerson | 704/230 |
| 4,896,361 | 1/1990 | Gerson | 704/222 |
| 4,912,764 | 3/1990 | Hartwell et al. | 704/207 |
| 5,574,824 | 11/1996 | Slyh et al. | 704/226 |

OTHER PUBLICATIONS

Aldo Cumani, "On A Covariance–Lattice Algorithm For Linear Prediction," ICASSP 82 Proceedings, May 3, 4, 5, 1982, Palais Des Congres, Paris, France, vol. 2 of 3, IEEE International Conference on Acoustics, Speech and Signal Processing, pp. 651–654.

*Primary Examiner*—Richemond Dorvil

*Attorney, Agent, or Firm*—Conley, Rose & Tayon; Jeffrey C. Hood

[57] ABSTRACT

A vocoder for generating speech from a plurality of stored speech parameters which efficiently computes a band limited noise signal for use in the speech production model. The band limited noise signal generator includes a white Gaussian noise generator coupled to a band-width limiting filter. The resulting band limited white Gaussian noise signal is provided to a bank of modulators, each having predetermined modulation frequency. The outputs of each of the modulators are provided to variable gain units and summed together to produce the band limited noise signal.

35 Claims, 11 Drawing Sheets

Representation of speech signals.

Range of bit for various types of speech representation.

Source-system model of speech production.

General discrete-time model for speech production.

Block diagram of simplified model for speech production.

SYSTEM AND METHOD FOR GENERATING RE-CONFIGURABLE BAND LIMITED NOISE USING MODULATION

FIELD OF THE INVENTION

The present invention relates generally to a voice production model or vocoder for generating speech from a plurality of stored speech parameters, and more particularly to a system and method for efficiently generating a re-configurable band limited noise signal using modulation to produce more naturally sounding reproduced speech.

DESCRIPTION OF THE RELATED ART

Digital storage and communication of voice or speech signals has become increasingly prevalent in modern society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

One key aspect for reproducing speech from a parametric representation involves a random noise generator for generating a proper noise signal. As discussed above, the noise signal is used to model unvoiced sounds. The noise signal added to the reconstructed speech signal provides a subjective "naturalness" to the tonal quality of the speech signal output. To provide this natural quality to the speech signal, it is desirable to selectively add noise to various parts of the speech signal spectrum and periodically adjust the frequency content of the noise signal. One way of providing the noise signal is to apply the output of a white Gaussian noise generator to a bank of band-pass filters. Each bank of band-pass filters corresponds to a desired sub-band. Because each sub-band is desired to have a sharp roll-off, a relatively complex filter for each sub-band is required. Such filters have transfer functions having ten or more coefficients and hence require a corresponding number of multiplications and additions per sub-band.

An alternative technique for generating the proper noise signal is to provide a sinusoidal signal noise generator and sum a sequence of sinusoidal signals for each band. As is well known, this technique is relatively complex and expensive due to the circuitry needed to generate and sum the sinusoids. In addition, this technique does not produce true white Gaussian noise and can contain tonal artifacts which can distort the reproduced speech signal. Thus, there is a need for a simpler and more accurate noise generator in a speech production model.

Therefore, an improved system and method is desired which more efficiently generates a band limited noise signal in a speech production model.

SUMMARY OF THE INVENTION

The present invention comprises a vocoder for generating speech from a plurality of stored speech parameters which efficiently generates a band limited noise signal in the speech production model. The present invention efficiently generates the band limited noise signal using a bank of modulators. The present invention comprises a band of modulators which modulate the noise sequence into one or more 500 Hz bands.

The system comprises a voice coder/decoder (codec) which preferably includes a digital signal processor (DSP) and also preferably includes a local memory. During encoding of the voice data, the voice codec receives voice input waveforms and generates a parametric representation of the voice data. A parameter storage memory is coupled to the voice codec for storing the parametric data. During decoding of the voice data, the voice codec receives the parametric data from the parameter storage memory and reproduces the voice waveforms. A CPU is preferably coupled to the voice codec for controlling the operations of the codec.

During the decoding or speech generation process, the present invention produces a noise signal to enhance the subjective naturalness of the resulting speech signal. A white noise generator is provided to generate an initial wide band signal having a constant power spectral density. The output of the white noise generator is provided to a bandwidth-restricting filter. The filter output is then provided to a plurality of double-side band modulators for each sub-band. The modulated frequency-restricted signals may have their gain individually adjusted as the user desires. The sub-bands are then summed back together and provided to the speech generator as band variable noise.

Broadly speaking, a band variable noise generator for speech production according to one aspect of the present invention comprises at least one white noise generator coupled to at least one bandwidth limiting or low pass filter. A bank of modulators is coupled to the bandwidth limiting filter or filters, each modulator having a different modulation frequency. Thus, when an output of the bandwidth limiting filter is selectively modulated by each of the modulators, outputs of the bank occupy a predetermined frequency range. In addition, a gain circuit may be coupled to adjust a gain of each of the modulators. Finally, an adder is provided to sum the outputs of the gain circuit to produce a band variable noise signal having the predetermined spectra.

BRIEF DESCRIPTION OF THE DRAWINGS

A better understanding of the present invention can be obtained when the following detailed description of the invention is considered in conjunction with the following drawings, in which.

DETAILED DESCRIPTION OF THE PREFERRED EMBODIMENT

Incorporation by Reference

The following references are hereby incorporated by reference.

Kang & Everett, "Improvement of the Narrowband Linear Predictive Coder; Part 2-Synthesis Improvements," NRL Report 8799, Jun. 11, 1984 is hereby incorporated by reference in its entirety.

For general information on speech coding, please see Rabiner and Schafer, *Digital Processing of Speech Signals*, Prentice Hall, 1978 which is hereby incorporated by reference in its entirety. Please also see Gersho and Gray, *Vector Quantization and Signal Compression*, Kluwer Academic Publishers, which is hereby incorporated by reference in its entirety.

Voice Storage and Retrieval System

Figure 6:
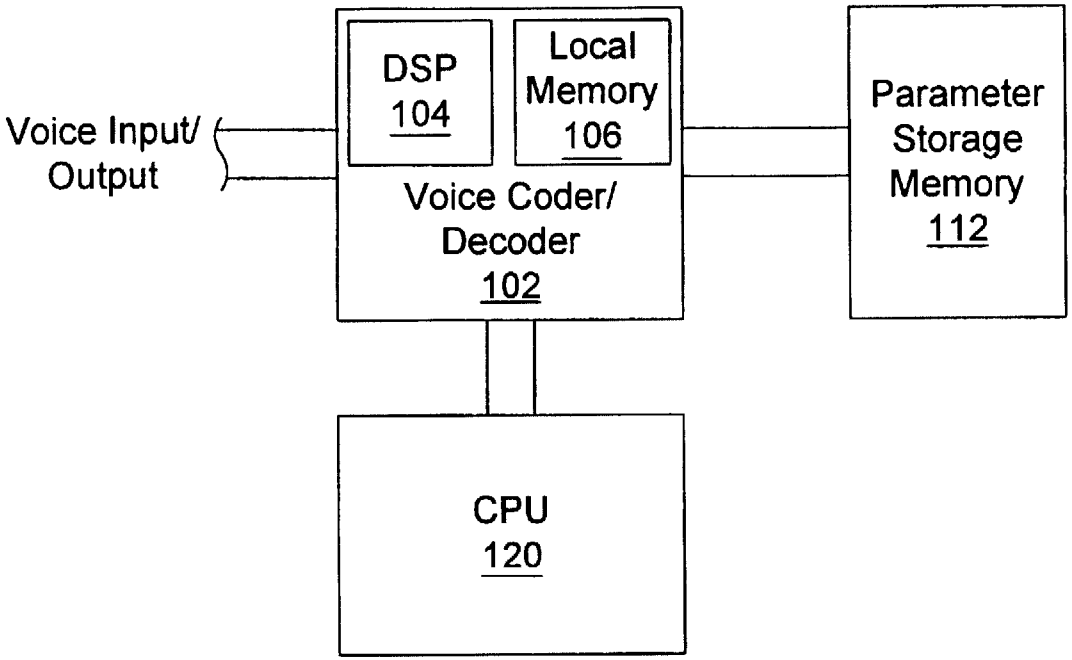
FIG. 6 is a block diagram of a speech storage system according to one embodiment of the present invention.

Referring now to FIG. 6, a block diagram illustrating a voice storage and retrieval system according to one embodiment of the invention is shown. The voice storage and retrieval system shown in FIG. 6 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (codec) 102. The voice coder/decoder 102 preferably includes a digital signal processor (DSP) 104 and local DSP memory 106. The local memory 106 serves as an analysis memory used by the DSP 104 in performing voice coding and decoding functions, i.e., voice compression and decompression, as well as parameter data smoothing. The local memory 106 preferably operates at a speed equivalent to the DSP 104 and thus has a relatively fast access time.

The voice coder/decoder 102 is coupled to a parameter parameter storage memory 112. The parameter storage memory 112 is used for storing coded voice parameters corresponding to the received voice input signal. In one embodiment, the parameter storage memory 112 is preferably low cost (slow) dynamic random access memory (DRAM). However, it is noted that the parameter storage memory 112 may comprise other storage media, such as a magnetic disk, flash memory, or other suitable storage media. A CPU 120 is preferably coupled to the voice coder/decoder 102 and controls operations of the voice coder/decoder 102, including operations of the DSP 104 and the DSP local memory 106 within the voice coder/decoder 102.

Alternate Embodiment

Figure 7:
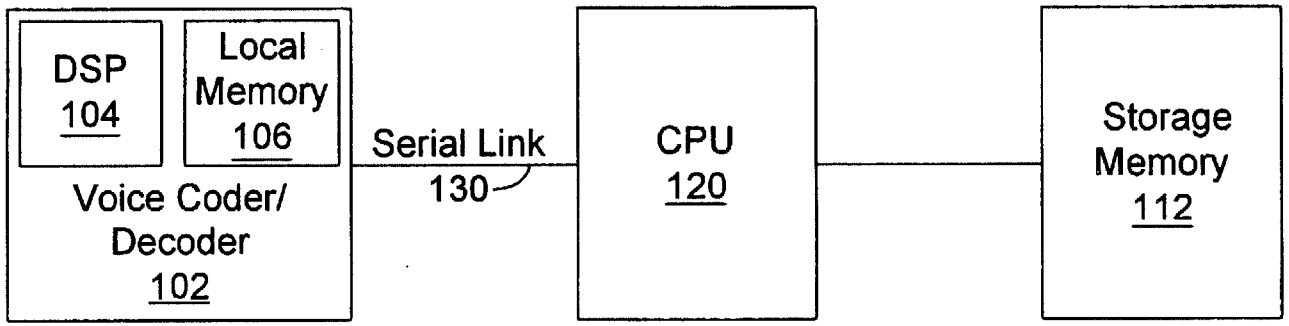
FIG. 7 is a block diagram of a speech storage system according to a second embodiment of the present invention.

Referring now to FIG. 7, an alternate embodiment of the voice storage and retrieval system is shown. Elements in FIG. 7 which correspond to elements in FIG. 6 have the same reference numerals for convenience. As shown, the voice coder/decoder 102 couples to the CPU 120 through a serial link 130. The CPU 120 in turn couples to the parameter parameter storage memory 112 as shown. The serial link 130 may comprise a dumb serial bus which is only capable of providing data from the parameter storage memory 112 in the order that the data is stored within the parameter storage memory 112. Alternatively, the serial link 130 may be a demand serial link, where the DSP 104 controls the demand for parameters in the parameter storage memory 112 and randomly accesses desired parameters in the parameter storage memory 112 regardless of how the parameters are stored. The embodiment of FIG. 7 can also more closely resemble the embodiment of FIG. 6 whereby the voice coder/decoder 102 couples directly to the parameter storage memory 112 via the serial link 130. In addition, a higher band-width bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Encoding Voice Data

Figure 8:
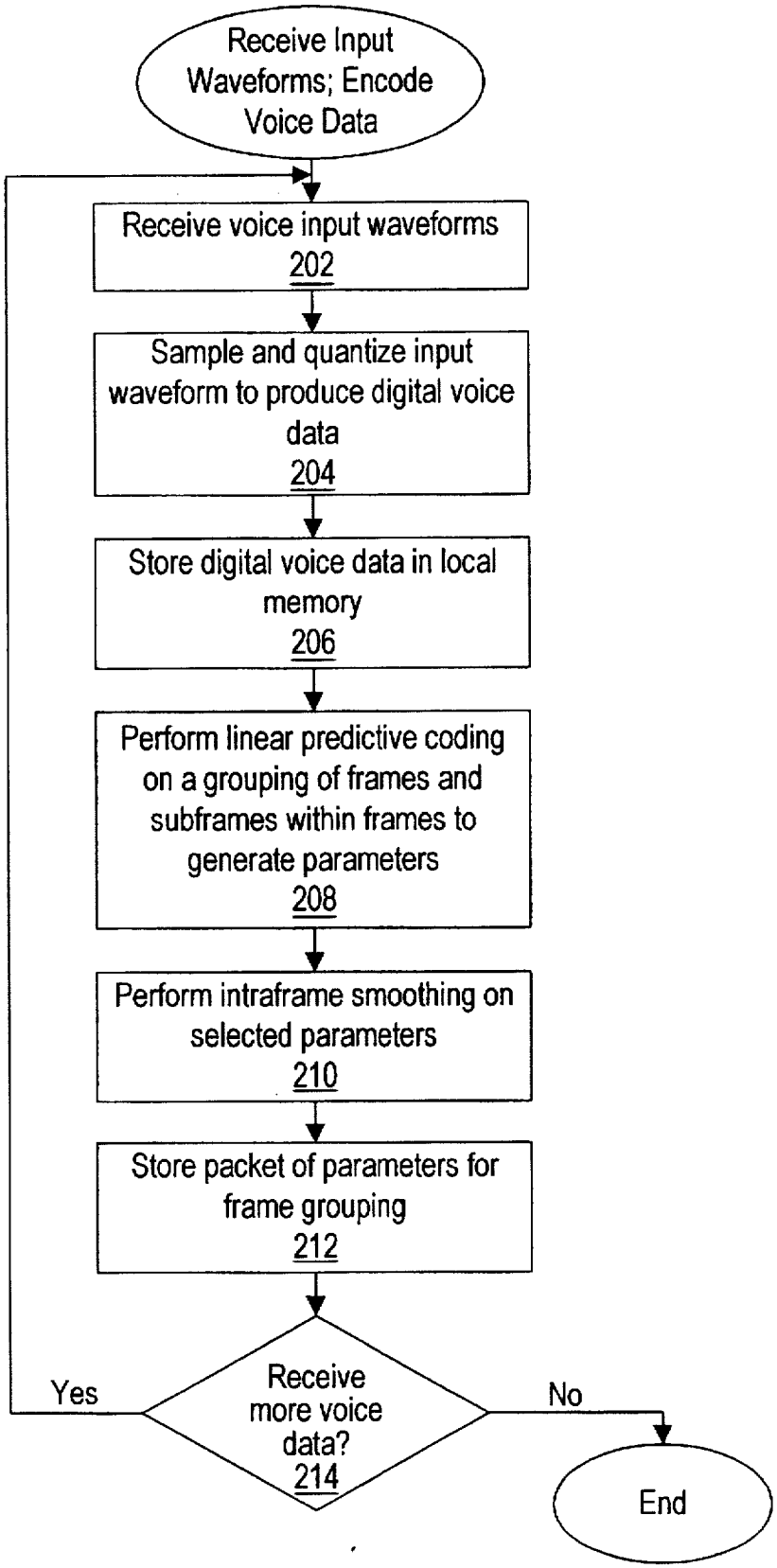
FIG. 8 is a flowchart diagram illustrating operation of speech signal encoding.

Referring now to FIG. 8, a flowchart diagram illustrating operation of the system of FIG. 6 encoding voice or speech signals into parametric data is shown. This description is included to illustrate how speech parameters are generated, and is otherwise not relevant to the present invention. It is noted that various other methods may be used to generate the speech parameters, as desired.

In step 202 the voice coder/decoder 102 receives voice input waveforms, which are analog waveforms corresponding to speech. In step 204 the DSP 104 samples and quantizes the input waveforms to produce digital voice data. The DSP 104 samples the input waveform according to a desired sampling rate. After sampling, the speech signal waveform is then quantized into digital values using a desired quantization method. In step 206 the DSP 104 stores the digital voice data or digital waveform values in the local memory 106 for analysis by the DSP 104.

While additional voice input data is being received, sampled, quantized, and stored in the local memory 106 in steps 202–206, the following steps are performed. In step 208 the DSP 104 performs encoding on a grouping of frames of the digital voice data to derive a set of parameters which describe the voice content of the respective frames being examined. Linear predictive coding is often used. However, it is noted that other types of coding methods may be used, as desired. For more information on digital processing and coding of speech signals, please see Rabiner and Schafer, *Digital Processing of Speech Signals*, Prentice Hall, 1978, which is hereby incorporated by reference in its entirety.

In step 208 the DSP 104 develops a set of parameters of different types for each frame of speech. The DSP 104 generates one or more parameters for each frame which represent the characteristics of the speech signal, including a pitch parameter, a voice/unvoice parameter, a gain parameter, a magnitude parameter, and a multi-based excitation parameter, among others. The DSP 104 may also generate other parameters for each frame or which span a grouping of multiple frames.

Once these parameters have been generated in step 208, in step 210 the DSP 104 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the DSP 104 stores this packet of parameters in the parameter storage memory 112 in step 212. If more speech waveform data is being received by the voice coder/decoder 102 in step 214, then operation returns to step 202, and steps 202–214 are repeated.

Decoding Voice Data—Speech Generation

Figure 9:
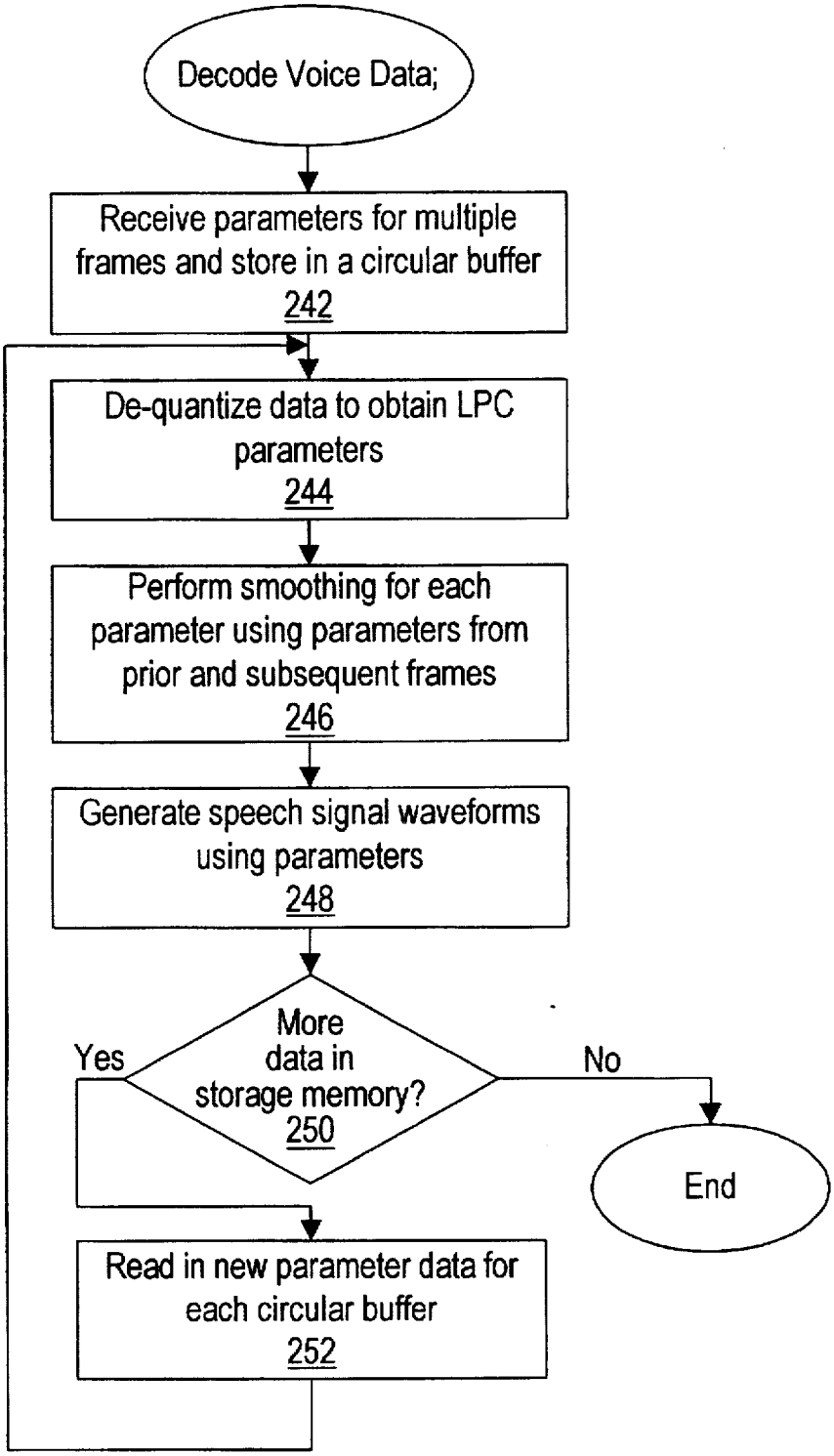
FIG. 9 is a flowchart diagram illustrating decoding of encoded parameters to generate speech waveform signals, wherein the decoding process includes generating excitation or noise signals in an improved manner according to the invention.

Referring now to FIG. 9, a flowchart diagram is shown illustrating the voice decoding process, whereby the voice decoding process includes improved and/or more efficient computation of excitation or noise signals according to the present invention. In step 242 the local memory 106 receives parameters for one or more frames of speech. In step 244 the DSP 104 de-quantizes the data to obtain 1pc parameters. For more information on this step please see Gersho and Gray, *Vector Quantization and Signal Compression*, Kluwer Academic Publishers, which is hereby incorporated by reference in its entirety.

In step 246 the DSP 104 optionally performs smoothing for respective parameters using parameters from zero or more prior and zero or more subsequent frames. As noted above, the smoothing process is optional any may not be performed, as desired. The smoothing process preferably comprises comparing the respective parameter value with like parameter values from neighboring frames and replacing discontinuities.

Figure 1:
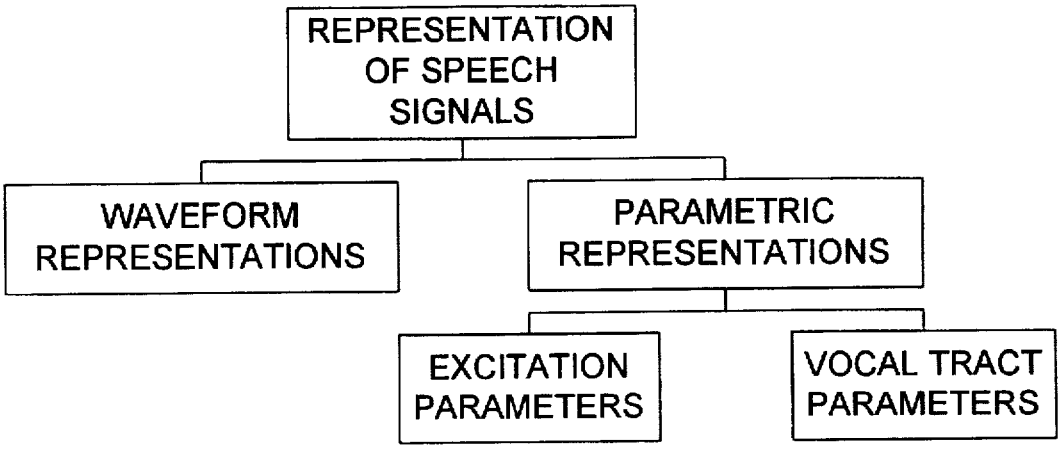
FIG. 1 (PRIOR ART)
FIG. 1 illustrates waveform representation and parametric representation methods used for representing speech signals.
Figure 2:
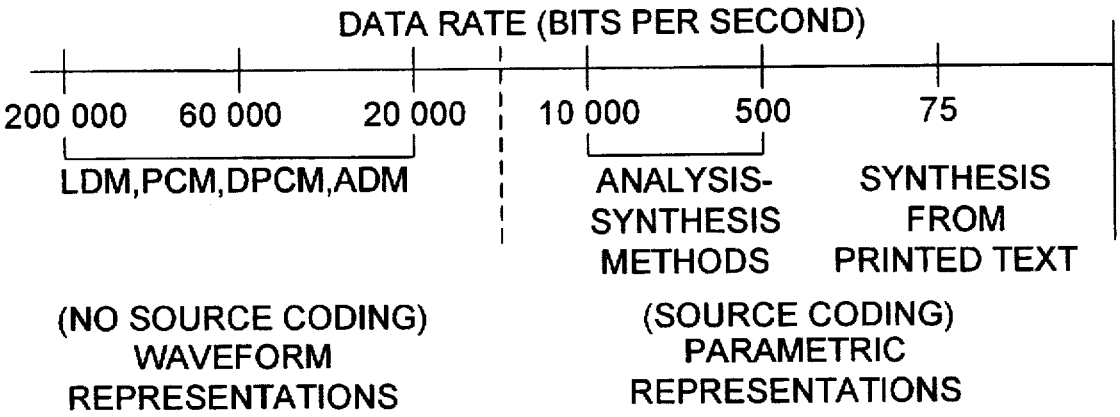
FIG. 2 (PRIOR ART)
FIG. 2 illustrates a range of bit rates for the speech representations illustrated in FIG. 1.
Figure 3:
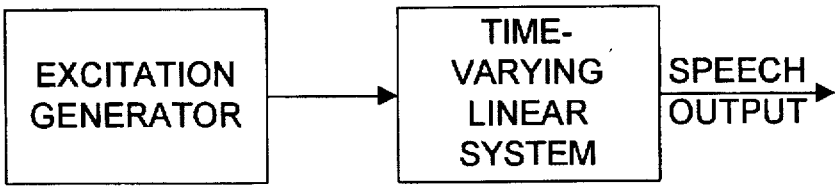
FIG. 3 (PRIOR ART)
FIG. 3 illustrates a basic model for speech production.
Figure 4:
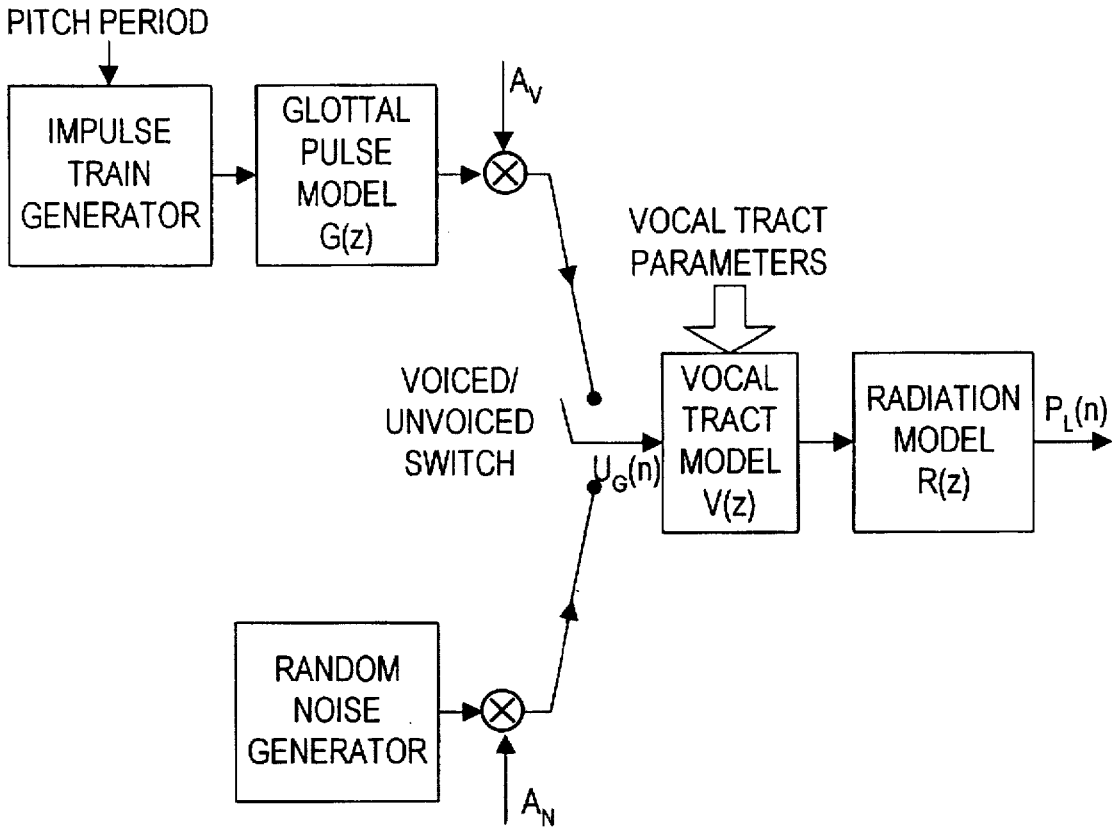
FIG. 4 (PRIOR ART)
FIG. 4 illustrates a generalized model for speech production.
Figure 5:
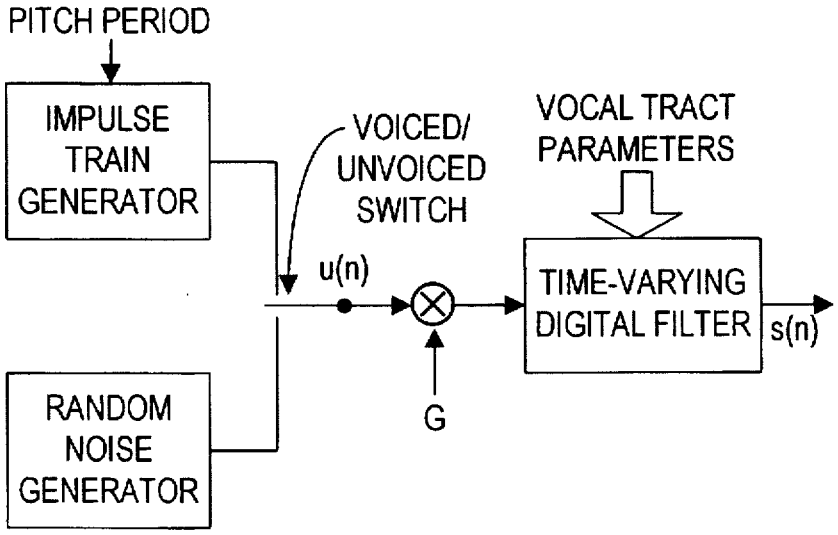
FIG. 5 (PRIOR ART)
FIG. 5 illustrates a model for speech production which includes a single time-varying digital filter.

In step 248 the DSP 104 generates speech signal waveforms using the speech parameters. The speech signal waveforms are generated using a speech production model as shown in FIGS. 4 or 5. For more information on this step, please see Rabiner and Schafer, *Digital Processing of Speech Signals*, referenced above, which is incorporated herein by reference. The DSP 104 preferably computes the excitation signals for the glottal pulse model using a linear phase delay. For more information on computing excitation signals using a linear phase delay and/or by adjusting the phase spectrum of the signals, please see Kang & Everett, "Improvement of the Narrowband Linear Predictive coder Part 2—Synthesis Improvements," NRL Report 8799, Jun. 11, 1984, which was referenced above, and which is hereby incorporated by reference in its entirety.

In step 248 the DSP 104 preferably computes a noise excitation signal in an efficient and optimized manner according to the present invention, as described below.

In step 250 the DSP 104 determines if more parameter data remains to be decoded in the parameter storage memory 112. If so, in step 252 the DSP 104 reads in a new parameter value for each circular buffer and returns to step 244. These new parameter values replace the least recent prior value in the respective circular buffers and thus allows the next parameter to be examined in the context of its neighboring parameters in the eight prior and subsequent frames. If no more parameter data remains to be decoded in the parameter storage memory 112 in step 250, then operation completes.

Generation of the Excitation Signal—Present Invention

Figure 10:
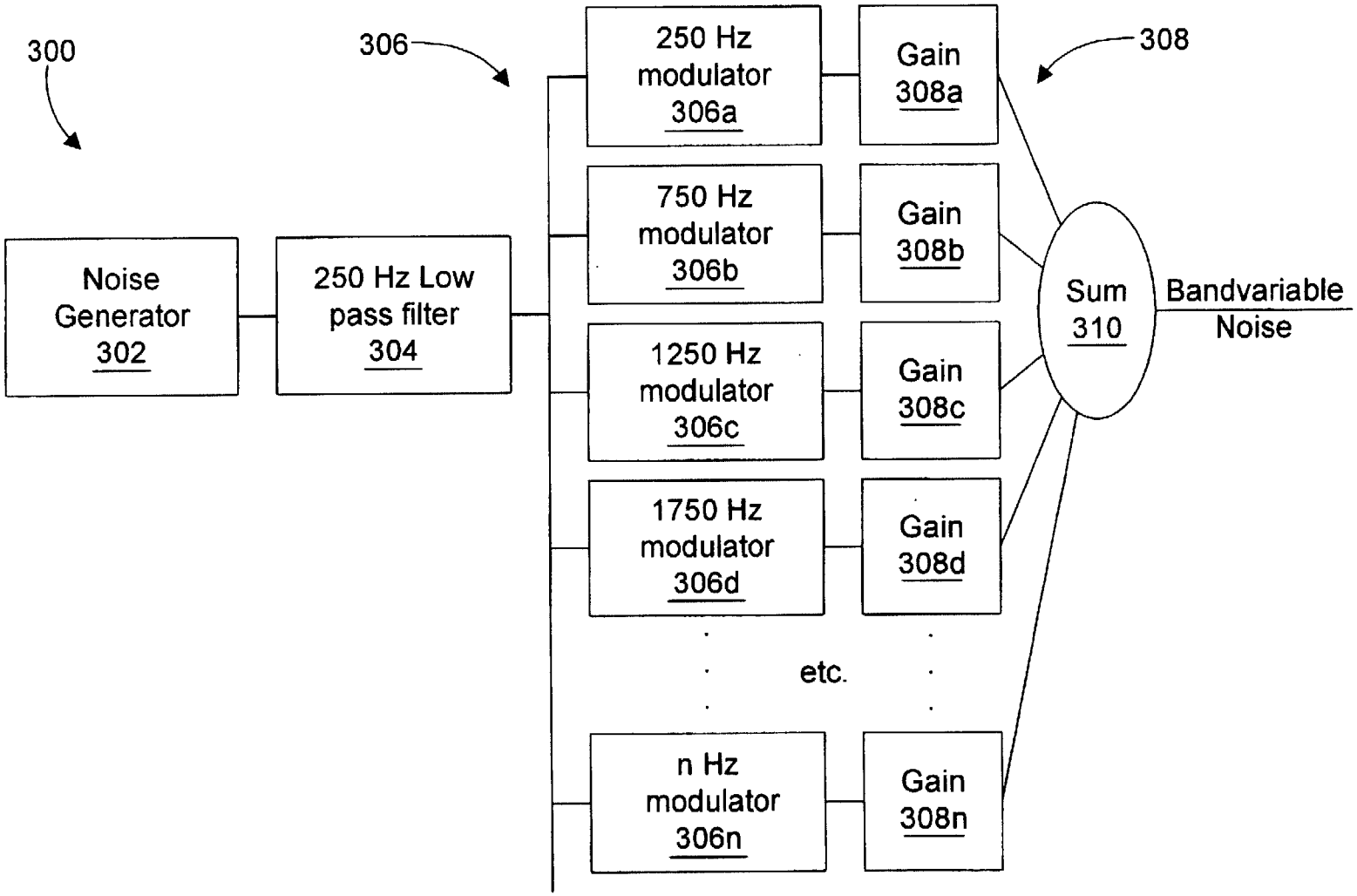
FIG. 10 is a block diagram illustrating a band-variable noise generator according to one embodiment of the present invention.

As noted above, in step 248 the DSP 104 generates speech signal waveforms using the speech parameters. The speech signal waveforms are generated using a speech production model such as that shown in FIG. 4. In producing the speech signal waveforms, the system generates a band limited noise signal that is provided to the vocal tract model. Referring now to FIG. 10, the present invention includes a band-variable noise generator 300.

The band-variable noise generator 300 may be implemented with discrete elements as shown in FIG. 10. In the preferred embodiment, the band-variable noise generator 300 is implemented at least in part by the programmable DSP 104. Band-variable noise generator 300 includes a noise generator 302. Noise generator 302 should be a white noise generator and is preferably a white Gaussian noise generator. Noise generator 302 generates a white noise signal having a constant power spectral density and incorporating all frequencies. The output of noise generator 302 is provided to low pass filter 304. Low pass filter 304 preferably restricts the band-width of the noise signal to 250 Hz. It is noted that a stop-band ripple of 30 decibels and a transition band-width of 100 Hz are considered adequate for performing the filtering operation. It is further noted that while filter 304 is preferably a low-pass filter, the present invention is not so limited. Filter 304 could be any type of general filter including low-pass, high-pass, band-pass or combinations thereof.

The output of low-pass filter 304 is provided to a bank of modulators 306. Each modulator **306*a* through 306*n* is preferably a double side-band modulator having modulation frequencies beginning at 250 Hz and increasing in 500 Hz increments. As is well known in the art, the output of 250 Hz low-pass filter 304 when fed an input of white Gaussian noise will have components in the range −250 Hz to 250 Hz. Each modulator will provide the modulated signal in a frequency band centered around the modulation frequency. Thus, modulator 306*a* having a modulation frequency of 250 Hz, will output a signal having a frequency range in the sub-band 0 Hz to 500 Hz. Modulator 306*b*, having a modulation frequency of 750 Hz, will output a signal having components in the range 500 Hz to 1000 Hz. In this fashion, the entire target frequency spectrum is provided using the modulation banks 306. It should be noted that using a single white noise generator 302** will result in some correlation of the reconstructed signal. In most applications, the resulting artifacts are insignificant, particularly after the noise has been applied to the vocal tract. However, should it be desirable to provide non-correlated signals, individual white noise generators can be provided for each band.

Turning back to FIG. 10, the output of each modulator **306*a* through 306*n* is provided to a gain control block 308*a* through 308*n*, respectively. The gain controls 308*a* through 308*n* enable the power or energy in each of the frequency sub-bands to be individually controlled and enable a wide range of band-variable noise sequences. It is noted that in order to decrease the complexity of the system, the gain and modulation unit can be combined into a single scaled modulation circuit to reduce the complexity of the system. Finally, the outputs of gain controls 308*a* through 308*n* are provided to summing circuit 310** to generate a same single band-variable noise signal.

Thus, the band-variable noise generator 300 can selectively generate a noise signal having various desired frequency spectra or frequency characteristics. The band-variable noise generator 300 of the present invention can selectively add noise to various parts of the signal spectrum, thus providing a distinct naturalness to the speech signal.

Figure 11:
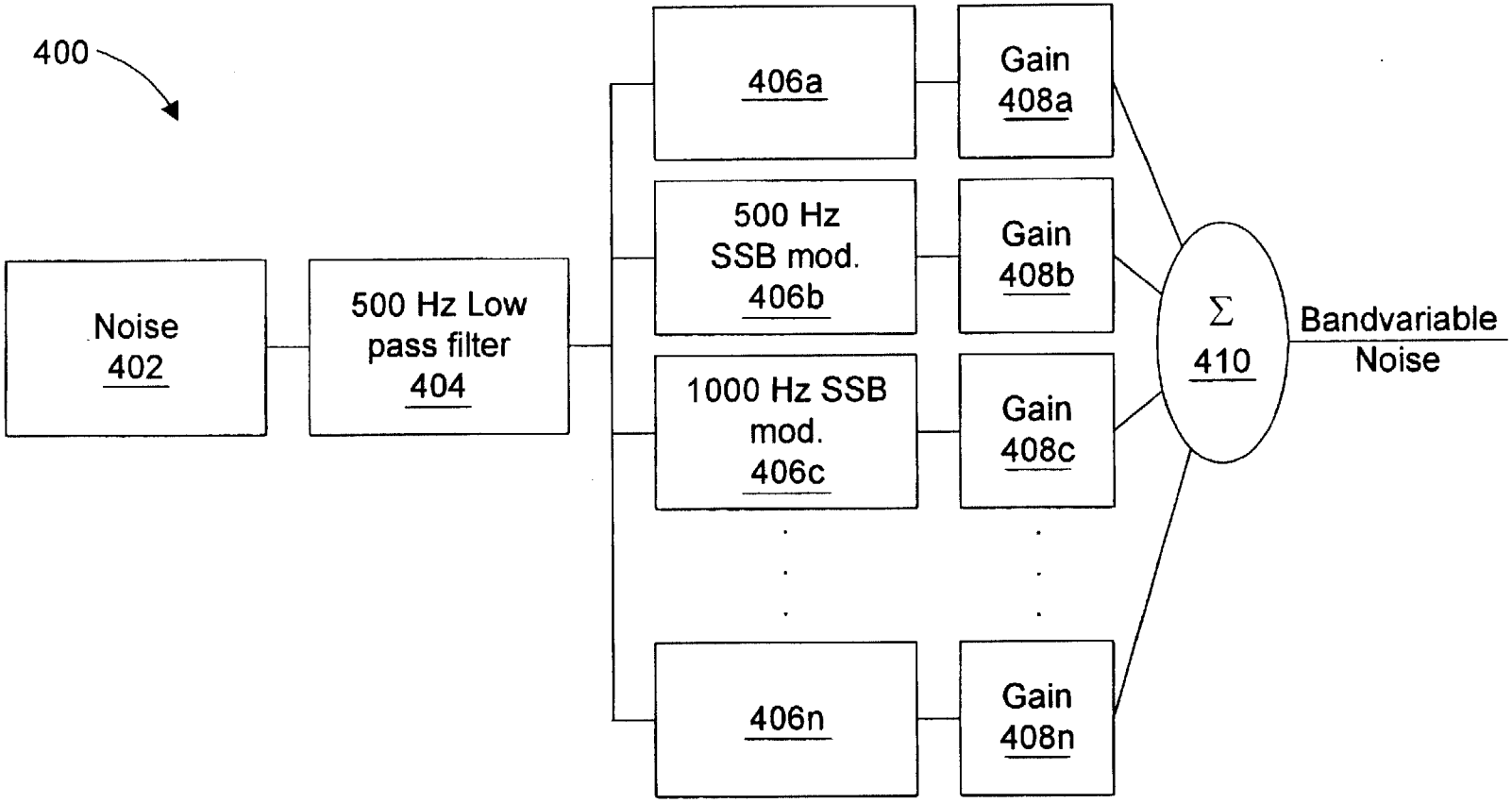
FIG. 11 is a block diagram illustrating another embodiment of a band-variable noise generator according to the present invention.

Turning now to FIG. 11 a block diagram is shown of an alternate embodiment of the invention. Noise generator 402 is coupled to a 500 Hz lowpass filter 404, in place of 250 Hz low-pass filter 304 of FIG. 10. Again, the noise generator 402 is preferably a white noise generator, and more particular, a white Gaussian noise generator. The 500 Hz low-pass filter 404 is followed by single side-band modulators **406*a* through 406*n*, of suitable frequencies such that the 500 Hz sub-bands are occupied. The single side-band modulators include, for example, a 500 Hz modulator 406*b*, a 1000 Hz modulator 406*c*, and so on. For example, the bandlimited signal output from the lowpass filter is modulated by an upper side band modulator 406*c* of 1000 Hz, which results in a signal residing in the range 1000 Hz through 1500 Hz. The frequencies of the other modulators are chosen accordingly. Further, it is noted that lower side band modulators could be employed. Thus, the output of 500 Hz lowpass filter 404 could be fed into a lower side band modulator of 1500 Hz, which would result in a signal of 1000 Hz through 1500 Hz. In a manner similar to that discussed above, the outputs from the modulators 406*a* through 406*n* are input to gain circuits 408*a* through 408*n*, respectively. The resulting outputs from the gain circuits 408*a* through 408*n* are summed together in unit 410 to output a band-variable noise signal. Thus, the band-variable noise generator of FIG. 11** also provides selective modulation of 500 Hz bands, using single side band modulators.

Figure 12:
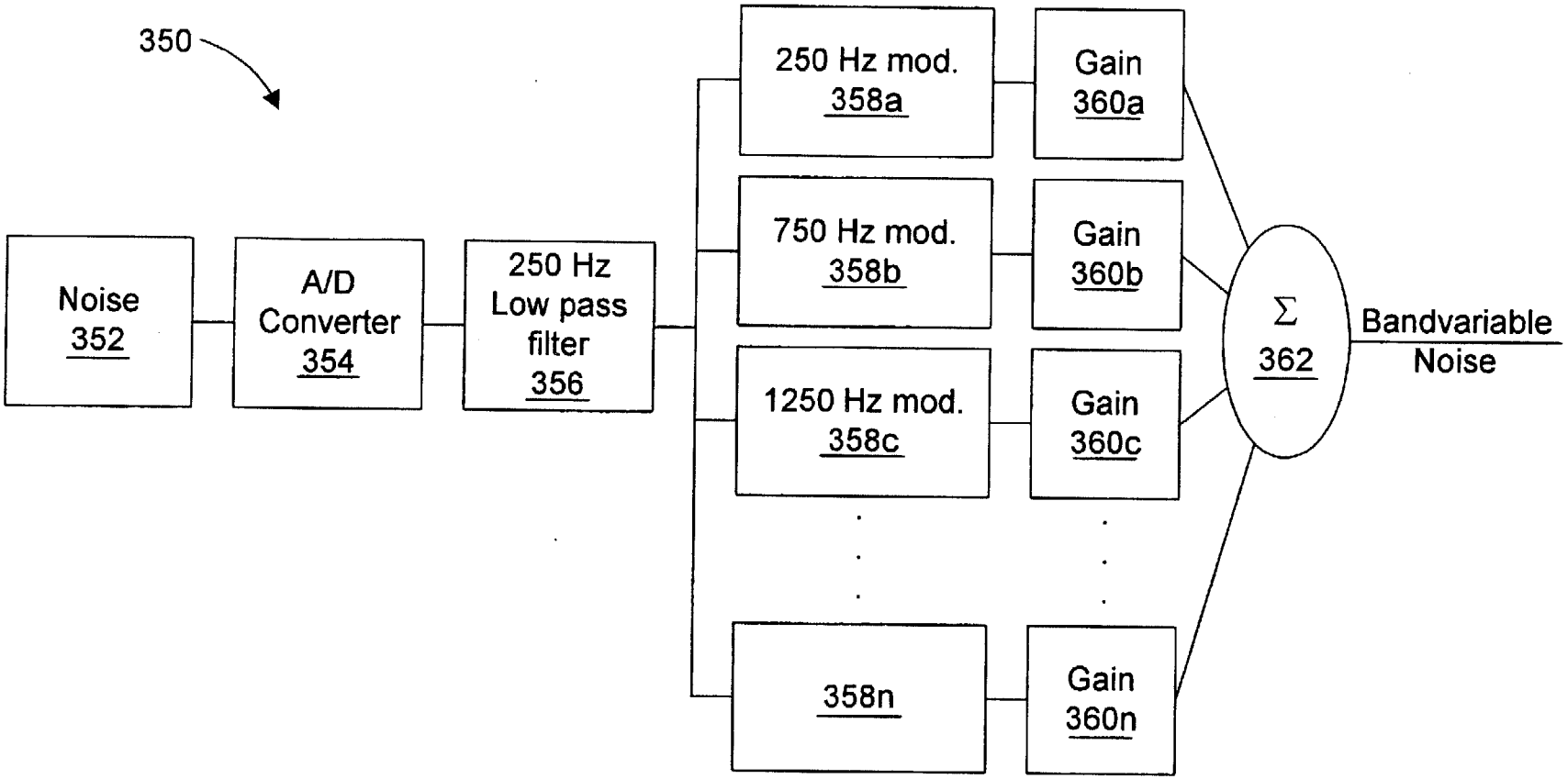
FIG. 12 is block diagram illustrating another embodiment of a band-variable noise generator according to the present invention.

It is noted that while the above discussion relates to analog implementation of a band limited noise generator, the noise generator is preferably implemented digitally. More particularly, turning now to FIG. 12, a block diagram is shown of a digital implementation of the band-variable noise generator. In the embodiment shown, the output from noise generator 352 is fed into an analog-to-digital (A/D) converter 354. Noise generator 352 should be a white noise generator and is preferably a white Gaussian noise generator. Analog-to-digital converter 354 preferably uses a sampling frequency of 8000 samples per second (which corresponds to the Nyquist sampling rate for the signal in the range 0–4000 Hz). The output of analog-to-digital converter 356 is coupled to 250 Hz lowpass filter 356 and fed into banks of modulators 358*a* through 358*n*, gain control circuits 360*a* through 360*n*, and summed in adder 362, as discussed above. It is noted that while an analog noise generator is shown, the noise may be generated digitally. In such an implementation, of course, there is no need for A/D converter 354. Such an embodiment would appear generally as in FIG. 10 or FIG. 11. It is further noted that, as is well know in the art, out of band frequencies are generated at multiples of the 8 kHz sampling rate, but should not affect operation of the noise generator.

Figure 13:
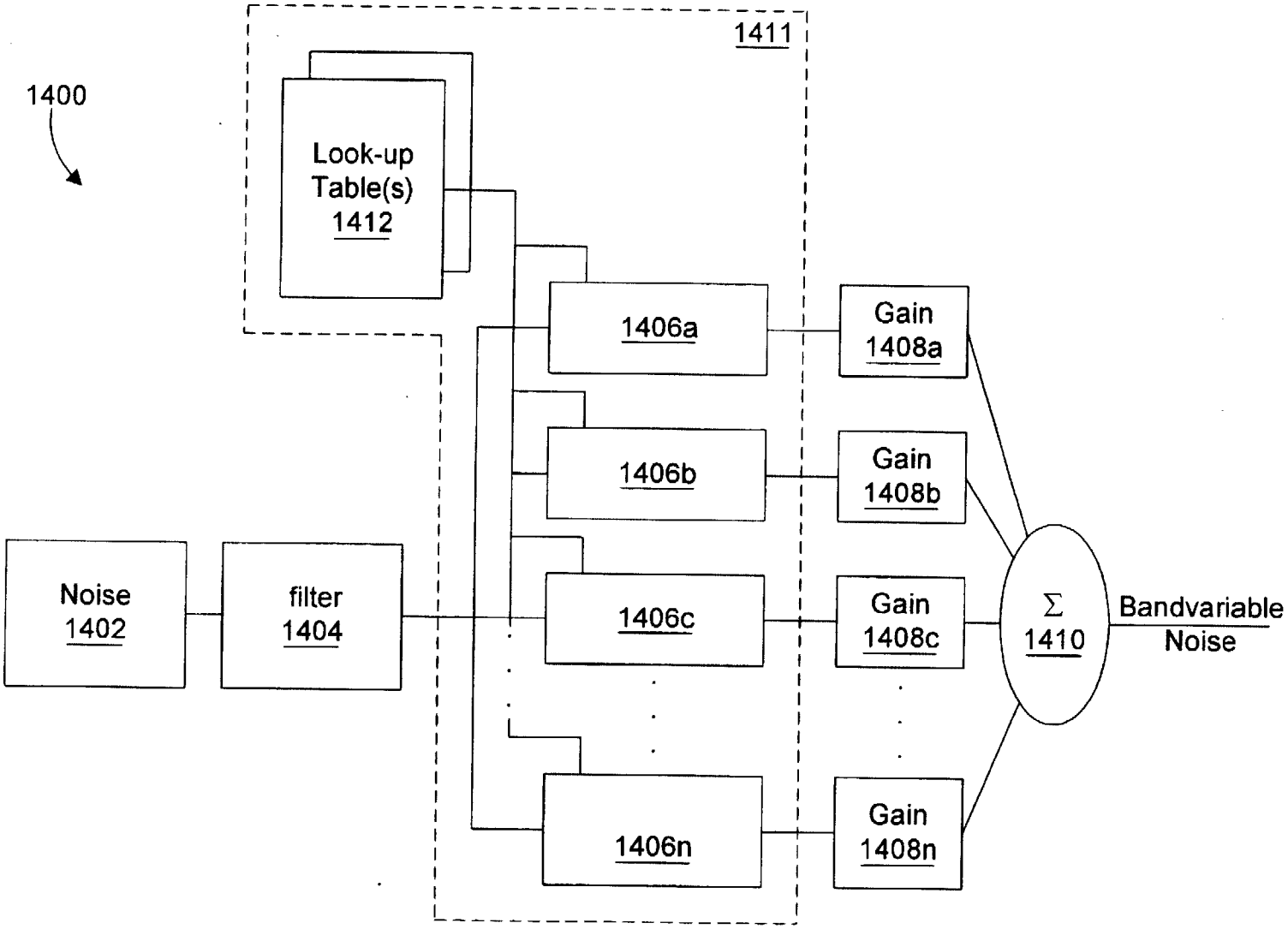
FIG. 13 is a block diagram illustrating another embodiment of a band-variable noise generator according to the present invention.

Furthermore, well-known look-up table techniques preferably are employed to generate the modulating signal sequences. More particularly, lookup tables may be used in a modulation unit for the sinusoids and phase angles to generate the modulating signals for each band. However, direct computation of the modulating signal for each modulator and each sample is also contemplated. An embodiment of the present invention having a modulation unit 1411 employing lookup tables is illustrated in FIG. 13. Band variable noise generator 1400 includes a noise generator 1402 (preferably white Gaussian) coupled to a filter 1404, which in turn is coupled to a bank of modulators 1406*a* through 1406*n*, which are coupled to look-up table or tables 1412. Each bank 1406*a* through 1406*n* accesses the table or tables 1412 for the sinusoids and phase values required for the modulating signals. The outputs of the modulators 1406*a* through 1406*n* are provided to gain circuits 1408*a* through 1408*n*. It is noted that the gain circuits 1408*a* through 1408*n* may be provided as part of the modulator bank circuits 1406*a* through 1406*n*. Finally, the signals are summed together in sum circuit 1410 to achieve a band-variable noise signal. It is noted that while a common look-up table or tables 1412 are illustrated, a look-up table may be provided for each bank. Thus, FIG. 13 is exemplary only.

It is further noted that the number and width of the frequency bands is arbitrary and can be set as appropriate for any given application. Moreover, the frequency bands need not be of equal widths. The output of white noise generators 302, 402, and 352 could be fed into an arbitrary number of filters, the outputs of which could also be fed into a bank of suitable modulators to cover the desired frequency range.

Figure 14:
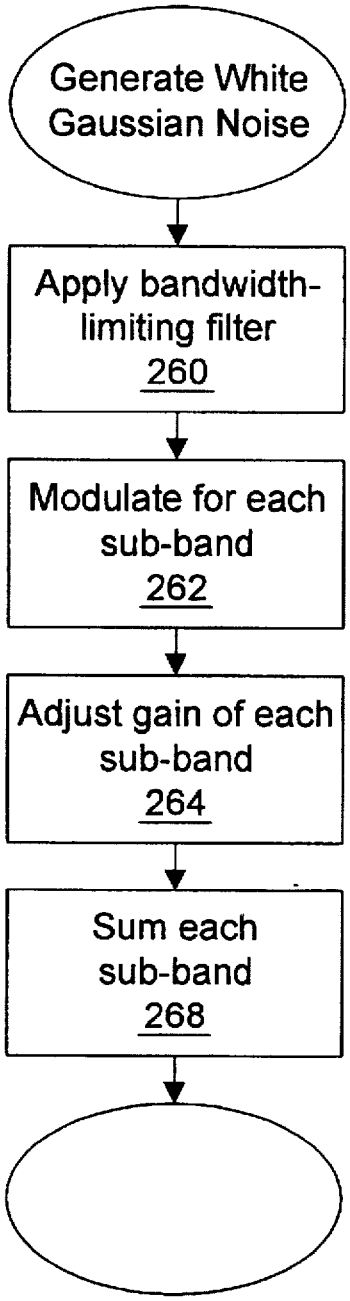
FIG. 14 is a flowchart diagram illustrating operation of the present invention.

Referring now to FIG. 14, a flowchart is shown illustrating a method for generating band-variable noise according to the present invention. White noise, and preferably Gaussian noise, is first generated and filtered by a band-width limiting filter (Step 260). In one digital implementation, the generating step is followed by or includes analog-to-digital conversion, as discussed above. In an alternative digital implementation, the noise itself is digitally generated. Further, as discussed above, band-width limiting filter may be any of a variety of relatively simple filters, such as lowpass or bandpass filters. The output of the band-width limiting filter (or analog to digital converter) is then modulated by modulators having modulation frequencies corresponding to each sub-band (Step 262). The modulated signals may then have their gain adjusted (step 264). This step may involve providing the outputs of the modulators to separate gain circuits. Alternately, gain control may be provided within the same circuit as the modulators in order to decrease part count and hence circuit complexity. Finally, each sub-band is summed to produce a band-variable noise signal (step 268). The resulting signal is then provided to the vocal tract model.

Conclusion

Therefore a system and method for generating noise excitation signals for a speech production model with improved computational efficiency is shown and described. The system and method of the present invention performs the required computations using only two adders and a multiplier in each modulator, thus simplifying the hardware and improving performance.

Although the method and apparatus of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A method for generating band-variable noise for a speech production model, comprising the steps of:

generating a white noise signal;

filtering the white noise signal to produce a band-width limited white noise signal;

selectively modulating said band-width limited white noise signal in a plurality of different frequency ranges to produce a plurality of modulated bandwidth limited white noise signals, wherein said plurality of modulated bandwidth limited white noise signals occupies a predetermined contiguous frequency range; and summing the plurality of modulated bandwidth limited white noise signals to produce a band-variable noise signal.

2. The method of claim 1, further including the steps of adjusting the gain of at least one of the modulated bandwidth limited white noise signals.

3. The method of claim 1, wherein said filtering the white noise signal includes providing said white noise signal to a bandwidth limiting filter.

4. The method of claim 3, wherein said filtering is low pass filtering.

5. The method of claim 4, wherein said low pass filtering is applying a 250 Hz bandwidth filter.

6. The method of claim 1, wherein said white noise signal is an analog signal.

7. The method of claim 6, further comprising converting said analog signal after said generating said white noise signal to a digital signal, and wherein said bandwidth limited white noise signal is a digital signal.

8. The method of claim 1, wherein said modulating includes performing double side band modulation.

9. The method of claim 1, wherein said modulating includes performing single sideband modulation.

10. The method of claim 1, wherein said modulating comprises modulating said bandwidth limited white noise signal in a plurality of different frequency ranges, each of said different frequency ranges having the same bandwidth.

11. The method of claim 1, wherein generating a white noise signal includes generating a white Gaussian noise signal.

12. A band-variable noise generator for speech production, comprising:

at least one white noise generator for generating white noise;

at least one bandwidth limiting filter operatively coupled to filter said white noise;

a bank of modulators coupled to the at least one bandwidth limiting filter, each modulator of said bank having a different modulation frequency, wherein each modulator of said bank modulates the output of said bandwidth limiting filter to produce outputs which occupy a predetermined frequency range;

an adder configured to sum the outputs which occupy a predetermined frequency range to produce a band-variable noise signal.

13. The band-variable noise generator of claim 12, wherein said at least one white noise generator is a white Gaussian noise generator.

14. The band-variable noise generator of claim 12, wherein said bandwidth limiting filter is a low pass filter.

15. The band-variable noise generator of claim 14, wherein said low pass filter has a bandwidth of 250 Hz.

16. The band-variable noise generator of claim 15, wherein said bank of modulators comprise double sideband modulators.

17. The band-variable noise generator of claim 14, wherein said low pass filters have a bandwidth of 500 Hz.

18. The band-variable noise generator of claim 17, wherein said bank of modulators comprise single sideband modulators.

19. The band-variable noise generator of claim 12, wherein at least two of said modulators have differing bandwidths.

20. The band-variable noise generator of claim 12 including an analog to digital converter coupling said at least one white noise generator and said at least one bandwidth limiting filter.

21. The band-variable noise generator of claim 12, wherein said at least one white noise generator is a digital white noise generator.

22. A band-variable noise generator for speech production, comprising:

at least one noise generator;

at least one bandwidth limiting filter coupled to filter an output of the at least one noise generator;

a bank of modulators coupled to the at least one bandwidth limiting filter, each modulator of said bank having a different modulation frequency, such that when an output of said bandwidth limiting filter is modulated, outputs of said bank occupy a predetermined frequency range;

an adder configured to sum the outputs of said bank to produce a band-variable noise signal.

23. The band-variable noise generator of claim 22, wherein said at least one noise generator is white noise generator.

24. The band-variable noise generator of claim 22, wherein said white noise generator is a white Gaussian noise generator.

25. The band-variable noise generator of claim 24, wherein said bandwidth limiting filter is a low pass filter.

26. The band-variable noise generator of claim 25, wherein said low pass filter has a bandwidth of 250 Hz.

27. The band-variable noise generator of claim 26, wherein said bank of modulators comprise double sideband modulators.

28. The band-variable noise generator of claim 25, wherein said low pass filters have a bandwidth of 500 Hz.

29. The band-variable noise generator of claim 28, wherein said bank of modulators comprise single sideband modulators.

30. The band-variable noise generator of claim 22, wherein at least two of said modulators have differing bandwidths.

31. A band-variable noise generator for speech production, comprising:

at least one noise generator;

at least one bandwidth limiting filter operatively coupled to filter an output of the at least one noise generator;

a modulation unit including a lookup table coupled to said at least one bandwidth limiting filter and configured to provide values for modulating said outputs such that modulated outputs occupy a predetermined frequency range; and an adder configured to sum the modulated outputs to produce a band-variable noise signal.

32. The band-variable noise generator of claim 31, further including at least one analog-to-digital converter coupled to the at least one noise generator.

33. The band-variable noise generator of claim 31, wherein said noise generator is a white noise generator.

34. The band-variable noise generator of claim 33, wherein said white noise generator is a white Gaussian noise generator.

35. The band-variable noise generator of claim 31, wherein said modulation unit includes at least one modulator coupled to access said lookup table and configured to generate a modulated output at a predetermined frequency range.

* * * * *